US008347949B2

(12) United States Patent
Anderson et al.

(10) Patent No.: US 8,347,949 B2
(45) Date of Patent: Jan. 8, 2013

(54) ELIMINATION OF SHRINKAGE CAVITY IN CAST INGOTS

(75) Inventors: Mark Anderson, Spokane Valley, WA (US); Todd F. Bischoff, Spokane Valley, WA (US); James Boorman, Greenacres, WA (US); Wayne J. Fenton, Spokane Valley, WA (US); David Sinden, Valleyford, WA (US); John Steven Tingey, Rathdrum, ID (US); Robert Bruce Wagstaff, Greenacres, WA (US)

(73) Assignee: Novelis Inc., Toronto, Ontario (CA)

( * ) Notice: Subject to any disclaimer, the term of this patent is extended or adjusted under 35 U.S.C. 154(b) by 0 days.

(21) Appl. No.: 13/333,469

(22) Filed: Dec. 21, 2011

(65) Prior Publication Data

US 2012/0160442 A1 Jun. 28, 2012

Related U.S. Application Data

(60) Provisional application No. 61/460,029, filed on Dec. 22, 2010.

(51) Int. Cl.
*B22D 11/049* (2006.01)

(52) U.S. Cl. ..... 164/483; 164/487

(58) Field of Classification Search ..... 164/483, 164/487

See application file for complete search history.

(56) References Cited

U.S. PATENT DOCUMENTS

| | | | |
|---|---|---|---|
| 3,262,165 | A | 7/1966 | Ingham |
| 4,081,168 | A | 3/1978 | Atterbury |
| 2005/0011630 | A1 | 1/2005 | Anderson et al. |
| 2010/0032455 | A1 | 2/2010 | Cooper et al. |

FOREIGN PATENT DOCUMENTS

| | | | |
|---|---|---|---|
| EP | 0 150 670 | A2 | 8/1985 |

OTHER PUBLICATIONS

Canadian Intellectual Property Office, International Search Report (Mar. 15, 2012), Int'l Appl'n. No. PCT/CA2011/050790 (Novelis Inc. et al.).

*Primary Examiner* — Kuang Lin
(74) *Attorney, Agent, or Firm* — Cooper & Dunham LLP

(57) ABSTRACT

An exemplary embodiment provides a method of eliminating a shrinkage cavity in a metal ingot cast by direct chill casting. The method involves casting an upright ingot having an upper surface at an intended height. Upon completion of the casting, the lower tip of the spout is maintained below the molten metal near the center of the upper surface. The metal flow through the spout is terminated and a partial shrinkage cavity is allowed to form as metal of the ingot shrinks and contracts. Before the partial cavity exposes the lower tip of the spout, the cavity is preferably over-filled with molten metal, while avoiding spillage of molten metal, and then the flow of metal through the spout is terminated. These steps are repeated until no further contraction of the metal causes any part of the upper surface to contract below the intended ingot height.

22 Claims, 7 Drawing Sheets

ELIMINATION OF SHRINKAGE CAVITY IN CAST INGOTS

CROSS-REFERENCE TO RELATED APPLICATIONS

This application claims the priority right of prior co-pending U.S. provisional Patent Application Ser. No. 61/460,029 filed on Dec. 22, 2010 by applicants named herein. The entire contents of Application Ser. No. 61/460,029 are specifically incorporated herein by this reference.

BACKGROUND OF THE INVENTION (1) Field of the Invention

This invention relates to the partial or complete elimination of shrinkage cavities in cast ingots. More particularly, the invention relates to the partial or complete elimination of such cavities that form during direct chill (DC) casting of metal ingots, especially (although not exclusively) ingots made of aluminum and aluminum-based alloys.

(2) Description of the Related Art

Metal ingots, especially those made of aluminum and aluminum-based alloys, may be formed by direct chill (DC) casting techniques in which molten metal is fed into the upper end of a chilled annular (usually rectangular) mold as an ingot support (a so-called "bottom block") is gradually caused to descend from an initial position closing the bottom end of the mold. The mold cools the body of molten metal in the mold around its periphery until the peripheral surface is sufficiently solid to support itself and to avoid leakage of molten metal from the hot center of the ingot. In this way, as the ingot support gradually descends, the ingot grows to a predetermined length while molten metal is continually introduced into the mold at the upper end. Cooling water is usually poured onto the surface of the ingot immediately below the bottom end of the mold to enhance the cooling process.

Once the ingot has reached its maximum length, the supply of molten metal is stopped and the ingot support remains fixed in place carrying the weight of the ingot. As the ingot cools and continues to solidify, the metal shrinks and contracts. Since the cooling commences from the peripheral surfaces of the ingot, the core of the ingot at its upper end is the last part to cool and solidify, and metal shrinkage becomes apparent from the appearance of a cavity which forms at a central position in the upper surface of the ingot. If this cavity is allowed to remain following complete ingot cooling, a portion of the upper end of the ingot is generally cut off below the cavity to provide the ingot with a flat upper surface. While the metal cut off in this way may be recycled, the procedure is nevertheless costly and inefficient. If the cavity is not removed in this way, a defect known as "alligatoring" may occur during rolling of the ingot. This involves the formation of tapered shapes (resembling the jaws of an alligator) extending from the two rolling faces of the ingot that eventually come together as rolling proceeds to form a two-layer laminate that has to be scrapped.

In the past, compensation for metal shrinkage has been provided by retaining a reservoir of molten metal above the nominal "upper surface" of the ingot so that further molten metal is available to descend into the cavity as the cavity is formed. As explained, for example, in U.S. Pat. No. 3,262,165 which issued to A. J. Ingham on Jul. 26, 1966, this can be done by providing the head of a mold with insulated walls that may be partially filled with a pool of molten metal that is kept molten by the insulation. Alternatively, shrinkage compensation may be accomplished by providing flexible hot topping liners which again provide an insulated space above the ingot for retaining a molten pool of metal. Such liners are disclosed, for example, in U.S. Pat. No. 4,081,168 which issued to R. E. Atterbury on Mar. 28, 1978. The use of such "hot tops" is not convenient for the direct chill casting process and again it may result in the need for the removal of an excess of metal from the upper part of the ingot as the molten reservoir itself cools and solidifies in contact with the ingot proper.

Ingham in the patent identified above also suggested repeated topping up of the solidifying mass, i.e. adding further molten metal to the cavity as the cavity forms. However, this solution is not generally possible in conventional direct chill casting apparatus because molten metal in the channels and spouts above the mold tends to solidify once the main casting operation has been terminated, and anyway the kind of precise control that would allow filling of the cavity while avoiding spillage has not generally been possible.

European patent application EP 0 150 670, which was published on Aug. 7, 1985 and names C. Alborghetti as the inventor, discloses a casting apparatus in which the level of metal in a mold or runner, or the like, is regulated by measuring the magnitude of eddy currents induced in the metal by means of a measuring coil, the magnitude being proportional to the distance from the coil to the metal melt. The monitoring of such distances is used in the electromagnetic casting of aluminum, but not with direct chill casting.

US patent publication no. US 2010/0032455, which was published on Feb. 11, 2010 and names Cooper et al. as inventors, discloses a control pin system for use in controlling the flow of molten metal in a distribution system for casting. The control pin controls the flow of molten metal through a spout and provides heating for the control pin or the spout to prevent solidification of metal in the spout when the flow is stopped.

Despite these disclosures, there is a need for an improved method of and apparatus for eliminating the shrinkage cavity in an ingot formed by direct chill casting.

BRIEF SUMMARY OF THE INVENTION

An exemplary embodiment provides a method of fully or partially eliminating a shrinkage cavity in a metal ingot cast by direct chill casting. The method involves casting a metal ingot by introducing molten metal into a direct chill casting mold from a spout to form an upright ingot having an upper surface at a predetermined height. Upon completion of the casting, the lower tip of the spout is preferably maintained below the upper surface in molten metal at or near a center of the upper surface of the ingot. The metal flow through the spout is terminated while maintaining sufficient heat in metal within and supplying the spout to keep the metal molten for subsequent delivery through the spout. A partial shrinkage cavity is allowed to form in the upper surface of the ingot as metal of the ingot shrinks and contracts. Preferably before the partial cavity exposes the lower tip of the spout, the partial shrinkage cavity is at least partially filled, and preferably filled or over-filled, with molten metal while all or significant spillage of molten metal from the partial cavity is avoided, and then the flow of metal through the spout is terminated. The steps of allowing a partial shrinkage cavity to form in the upper surface and then at least partially filling, and preferably filling or over-filling, the partial shrinkage cavity with molten metal from the spout before the cavity exposes the lower tip are repeated at least once, and preferably (if fully cavity elimination is required) until no further contraction or shrinkage of the metal of the ingot causes any part of the upper surface to contract or shrink below the predetermined height. The spout is then removed from contact with molten metal of the ingot and all parts of the ingot are allowed to cool to a temperature at which the metal is fully solid.

The term "partial shrinkage cavity" as used herein means a cavity that represents only a part of the size of the full cavity resulting from metal shrinkage and contraction that forms in an ingot after complete cooling if no means of cavity filling are employed. That is to say, a partial shrinkage cavity is one having a predetermined depth that is less than the depth of a fully formed shrinkage cavity.

The term "at least partially filling" a partial shrinkage cavity includes over-filling such a cavity, exactly filling such a cavity or only partially filling such a cavity. The term "over-filling" or "over-filled" mean that molten metal is introduced into a partial shrinkage cavity to a height above the level of the surrounding solid cavity rim but without substantial molten metal spillage from the cavity. This is possible because of the surface tension of the molten metal that allows a downwardly turned confining meniscus to form around the periphery of the metal pool as it rises for a distance above the rim of the cavity. The term "filling" such a cavity means that the cavity is filled to an extent that the surface of the metal pool reaches, but does not exceed, the height of the surrounding solid rim of the cavity. The term "partial filling" is clearly an amount of metal introduction less than that required for "filling". If "over-filling" is not used for all of the steps, it is most preferably used for one or more of the last steps. Over-filling makes more molten metal available to feed into a partial shrinkage cavity as cooling proceeds and this excess tends to be more significant in the later filling steps when the volumes of the cavities are becoming smaller. Preferably, all of the filling steps involve either filling or over-filling of the partial shrinkage cavities. For the sake of simplicity, the term "cavity filling", "filling steps", and the like as used in the description below are intended as a generic terms covering all of partial cavity filling, exact cavity filling and cavity over-filling, unless the context makes it clear that they relate only to exact cavity filling. Also, these terms refer to the filling of partial shrinkage cavities as will be understood.

The repeated filling steps tend to produce an ingot having a stepped elevated "crown" at the upper surface, especially when over-filling is carried out. However, as the ingot head contracts, the metal in the head may solidify in a way that forms a stepped crown shape even when mere partial filling is carried out.

There may be as few as two cavity filling steps, but normally there are at least three and may be as many as 15 or more. The pauses between these steps are generally long enough to allow solidification of metal at the periphery of the metal pool in the ingot and sufficient shrinkage to form a defined partial shrinkage cavity, i.e. a measurable reduction in surface height of the metal pool. Preferably, the pauses are not made so long that the lowermost tip of the metal-delivery spout is exposed to atmospheric air.

Another exemplary embodiment provides a method of eliminating a shrinkage cavity in a metal ingot cast by direct chill casting. The method comprises casting a metal ingot by introducing molten metal into a direct chill casting mold from a spout to form an upright ingot having an upper surface at a predetermined height. Upon completion of the casting, molten metal flow through the spout is terminated while sufficient heat in metal within and supplying the spout is maintained to keep the metal molten for subsequent delivery through the spout. A partial shrinkage cavity is allowed to form in the upper surface of the ingot as metal of the ingot contracts, and then the partial shrinkage cavity is over-filled while all or significant spillage of molten metal from the partial cavity is avoided, and then the flow of metal through the spout is terminated. The steps of allowing a partial shrinkage cavity to form in the upper surface, then over-filling the partial shrinkage cavity with molten metal from the spout, followed by termination of the flow of metal through the spout, are repeated at least once. The repetition of the steps is then terminated when no further shrinkage or contraction of the metal of the ingot causes any part of the upper surface to shrink or contract below the predetermined height. The spout is then removed from contact with molten metal of the ingot and all parts of the ingot are allowed to cool to a temperature at which the metal is fully solid.

The commencement of each cavity filling operation may be determined according to a time schedule or according to the measured height of a region of the surface of the metal pool as it descends into the ingot. If the shrinkage rate of an ingot is well known, cavity filling operations can be timed to take place at intervals sufficient to allow the formation of partial shrinkage cavities of suitable depth. More preferably, however, the depths of the partial shrinkage cavities are measured, and the filling operations commenced when the depths reach predetermined sensed levels. Cavity depth measurements may be achieved in several ways, e.g. visually by an operator (who actuates a switch to commence a filling operation when a cavity of suitable depth is observed) or automatically by means of a sensor, e.g. by the use of a laser surface height detector or an optical device designed to trigger a filling operation automatically when a predetermined partial shrinkage cavity depth is detected. However, the depths of the partial shrinkage cavities are most preferably determined by means of a sensor that induces an electrical current in the molten metal and uses the strength of the induced current as an indicator of cavity depth. When a sensor is employed that operates close to the molten metal surface, such as the kind of sensor that induces electrical currents, the sensor is preferably raised in height as the partial filling steps proceed in order to avoid contact between the sensor and the molten metal filling a partial shrinkage cavity. Such raising or elevation of the sensor may be carried out step-wise (e.g. after the end of each filling step), but is more preferably carried out continuously at a fixed rate effective to avoid unwanted sensor/metal contact. The difference in measured separation between the sensor and the molten metal may then be fed to a logic controller that calculates the surface height of the cavity despite the movement of the sensor and determines when an ongoing filling step is to be terminated and when a further step is to be commenced after a suitable pause.

While the molten metal may be introduced continuously into the partial shrinkage cavity as it forms, i.e. without pauses between the cavity filling steps, it is difficult to properly control the filling rate to avoid metal spillage, especially if the ingot is one of several being subjected to cavity filling at the same time (as often occurs in casting apparatus having a mold table containing several DC casting molds operating at the same time). It is therefore desirable to fill the cavity in a number of discrete filling steps separated by pauses during which the molten metal flow into the cavity is stopped and the metal allowed to cool and contract without being disturbed. The pause between each filling step allows the a partial casting cavity to re-form to a depth that allows a further filling step to be carried out without risk of the molten metal pouring over the top of previously-solidified metal to cause a "fold" (a defect that cannot usually be allowed to remain when an ingot is sent to a rolling mill). The minimum duration of the pause is dependent upon the rate of cooling and contraction of the molten metal, which is mainly dependent on the cooling effect of the water that is normally kept flowing over the outside of the ingot during this operation, and the thermal conductivity of the alloy being cast. While the minimum duration may thus vary, it is normally no less than 5 seconds, often no less than 10 seconds, and more usually no less than 15 seconds. It may be said, therefore, that the minimum normally falls within the range of 5-15 seconds, and more normally 10-15 seconds. Therefore, the number of filling steps is determined by some or all of the following considerations: the duration of such pauses, the time required for each filling step, and the time required for the elimination of the cavity to a desired extent, or the quantity of molten metal available for the filling steps. The quantity of available molten metal may itself be determined by the quantity of molten metal in the filling spout and launder supplying the spout (after termination of casting proper), or the rate of cooling of the molten metal since the metal is no longer available for cavity filling once it has cooled sufficiently to become solid.

While the exemplary embodiments may be employed for complete shrinkage cavity elimination, they may also be employed for partial cavity elimination, i.e. partial cavity filling. Partial cavity filling still provides a benefit over no cavity filling at all since less metal has then to be discarded from the ingot before or after rolling. Moreover, mere partial cavity elimination may be necessary in some cases when insufficient molten metal is available for full cavity elimination following the completion of casting proper. Furthermore, because the ingots are generally still being cooled with water during the cavity filling operation, the shape of the partial cavities changes and becomes narrower as cavity filling proceeds and cooling from the sides continues, thus even if a remaining cavity extends below the predetermined height of the upper surface of the cavity, such a cavity displaces less metal from the ingot than would a "natural" cavity (one formed without filling operations) of the same depth.

The availability of molten metal for the filling steps at the termination of casting proper may be ensured by various means. At the end of casting, the molten metal furnace used to supply metal to the mold is often tilted back so that the flow of metal to the mold is terminated. However, molten metal is still present in the launders or other channels provided to transfer the molten metal from the furnace to the mold. One or more dams may be employed to maintain the molten metal level in the launders before the furnace is tilted back, thus retaining molten metal for cavity filling. However, as soon as such metal freezes in the launders, or the spouts supplying the molds, the metal is no longer available for cavity filling operations. If metal cooling is likely to be too rapid, metal freezing can be delayed or prevented by providing the molten metal with additional heat. This may be done, for example, by providing heaters for the launders and/or spouts (e.g. electrical heaters in the walls of launders and/or spouts or immersed in the metal), or by providing heat from the exteriors of the launders or spouts, e.g. by directing a flame (e.g. from a propane torch or the like) onto the exteriors of these parts. A combination of metal dams and channel/spout heaters may be employed.

The exemplary embodiments may be employed for the casting of single layer ingots (as illustrated below) or multiple layer ingots, i.e. ingots cast with a core layer and at least one cladding layer. In the latter case, the cladding layers are usually quite thin relative to the core, so no compensation for metal shrinkage is required and the exemplary embodiments are employed only for the thicker core layer.

The exemplary embodiments may be carried out during the casting of a variety of metals, such as iron, copper, magnesium, aluminum and alloys thereof. Basically, the method may be suitable for any metal that tends to form a shrinkage cavity and, if over-filling is desired, for any metal that does not wet a solid surface of the same metal (thereby making over-filling possible). Aluminum and aluminum-based alloys are especially suitable.

BRIEF DESCRIPTION OF THE SEVERAL VIEWS OF THE DRAWINGS

Exemplary embodiments of the invention are described in detail in the following with reference to the accompanying drawings, in which.

DETAILED DESCRIPTION OF THE EXEMPLARY EMBODIMENTS

The term "annular" as used herein to describe a mold means a mold that has an effectively continuous mold wall or casting surface of any desired shape that encircles or circumscribes a casting cavity having an open inlet and outlet. The shape of the mold wall is often rectangular or square, but may be round or any other symmetrical or even non-symmetrical shape to produce ingots of corresponding cross-sectional shapes. If desired, the encircling mold wall may be adjustable in length and/or shape, e.g. by providing end walls that are slidable between a pair of parallel side walls to vary the cross-sectional area and shape of the casting cavity defined by the walls. In such an arrangement, although the end walls may not be integral with the side walls, the walls fit together closely so that the combined mold wall made up of the end walls and side walls is effectively continuous and avoids molten metal leakage.

Figure 1:
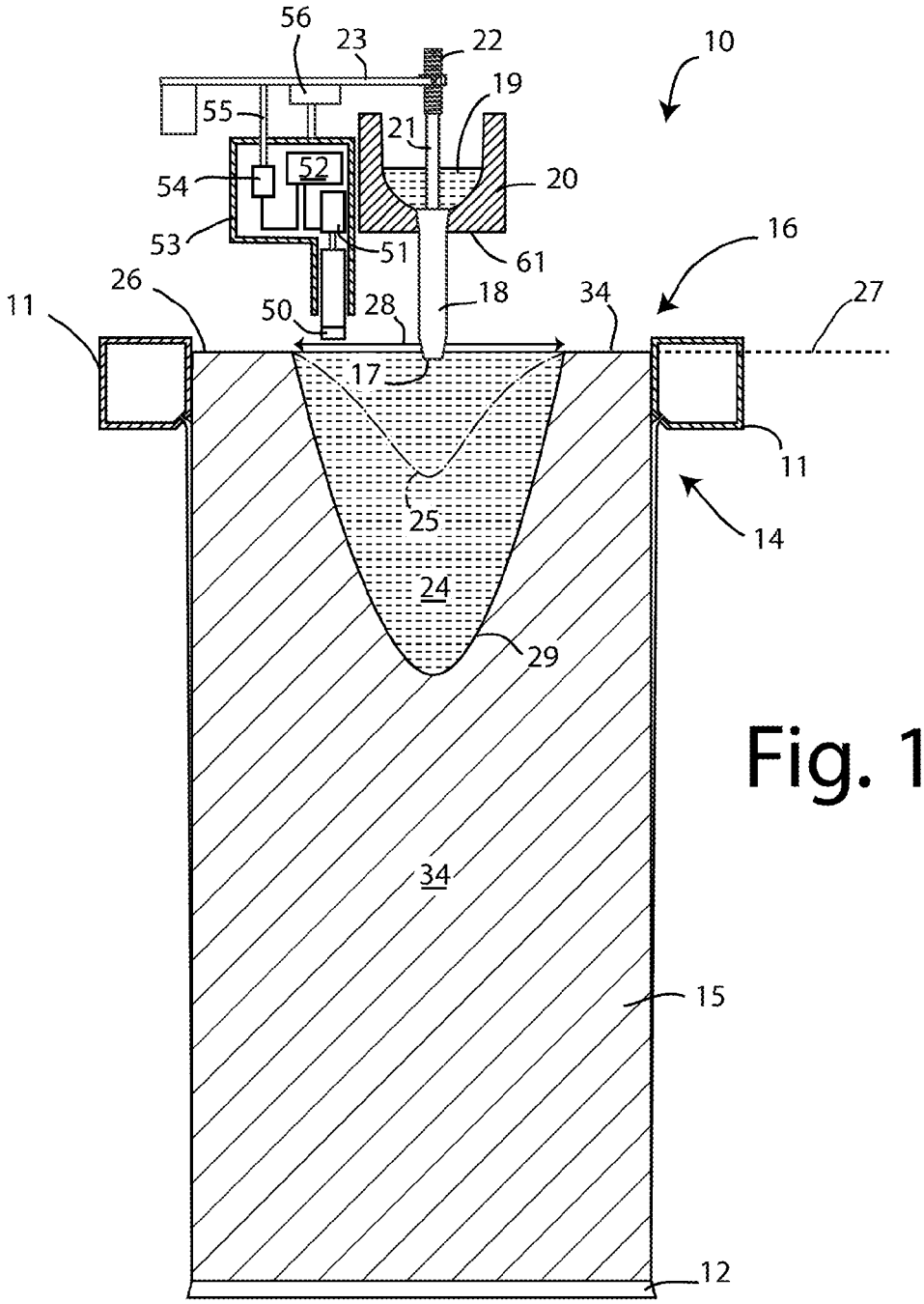
FIG. 1 is a simplified schematic diagram showing a direct chill casting apparatus at the end of a casting operation and including apparatus according to an exemplary embodiment.

FIG. 1 is a simplified schematic vertical cross-section of an upright direct chill casting apparatus 10 at the end of a casting operation. The apparatus includes a water-cooled direct chill casting mold 11, preferably of rectangular annular form in top plan view but optionally circular or of other shape, and a bottom block 12 that is moved gradually vertically downwardly by suitable support means (not shown) during the casting operation from an upper position initially closing and sealing a lower end 14 of the mold 11 to a lower position (as shown) supporting a fully-formed cast ingot 15. The ingot is produced in the casting operation by introducing molten metal into an upper end 16 of the mold through a vertical hollow spout 18 or equivalent metal feed mechanism while the bottom block 12 is slowly lowered. Molten metal 19 is supplied to the spout 18 from a metal melting furnace (not shown) via a launder 20 forming a horizontal channel above the mold. The spout 18 encircles a lower end of a control pin 21 that regulates and periodically terminates the flow of molten metal through the spout in a manner that will be described more fully later. The control pin 21 has an upper end 22 extending upwardly from the spout. The upper end 22 is pivotally attached to a control arm 23 that raises or lowers the control pin as required to regulate or terminate the flow of molten metal through the spout. During the casting operation, the control pin 21 is held is a raised position by control arm 23 so that molten metal may run freely and quickly through the spout 18 and into the mold 11. For casting, the launder 20 and spout 18 are lowered sufficiently to allow a lower tip 17 of the spout to dip into molten metal forming a pool 24 in the embryonic ingot to avoid splashing of and turbulence in the molten metal. This minimizes oxide formation and introduces fresh molten metal below an oxide film that forms at the top of the metal pool. The tip may also be provided with a distribution bag (not shown) in the form of a metal mesh fabric that helps to distribute and filter the molten metal as it enters the mold. At the completion of casting, the control pin 21 is moved to a lower position where it blocks the spout and completely prevents molten metal from passing through the spout, thereby terminating the molten metal flow into the mold. At this time, the bottom block 12 no longer descends, or descends further only by a small amount, and the newly-cast ingot 15 remains in place supported by the bottom block 12 with its upper end still in the mold 11. During the casting operation, cooling water is poured onto the exterior of the ingot 15 from openings in the mold 11 around its lower periphery, and this is preferably continued for a time after the casting is terminated. The pool of molten metal 24 remains above an interface 29 with a fully solid region 34 of the ingot. As time passes and the ingot cools further and continues to solidify, the interface 29 ascends through the ingot and the metal pool shrinks and eventually disappears when the ingot is fully solid. At the interface 29, solid dendrites grow from the solid surface and shrink, drawing in surrounding molten metal and causing a reduction of the surface height of the metal pool 24, thereby causing the formation of a casting cavity 25 upon full solidification of the ingot. At the point of completion of casting, but prior to further cooling, the ingot has an upper surface 26 at a predetermined desired vertical height 27 as shown, and the surface 26 is essentially flat, even though the ingot still has a metal pool 24 surrounded by solidified metal of the fully solid region 34 at the surface. The predetermined desired height 27 represents the intended position of the upper end of the ingot that would be achieved if no metal shrinkage occurred. However, as the ingot cools and solidifies further after completion of casting, the metal shrinks and contracts and eventually the shrinkage cavity 25 forms at the center of the upper face 26 of the ingot and reaches a considerable depth below the predetermined surface height 27. For example, cavity depths of 100 to 150 mm or more are common for ingots of commercial size. The shrinkage takes place in a central region 28 of the upper surface corresponding generally to the surface of the molten metal pool 24 at the end of the casting operation. The region 28 is spaced inwardly from the sides and ends of the ingot 15 because this part of the ingot cools and solidifies later than the sides and ends where heat loss is faster.

According to an exemplary embodiment, the metal within the spout 18 and metal in the launder 20 supplying the spout are kept molten after completion of the casting operation preferably in a manner explained more fully later. Then, as the shrinkage commences and a shrinkage cavity 25 starts to form in the upper surface 26 of the ingot, producing a partial shrinkage cavity, molten metal from the spout 18 is delivered to the molten pool 24 to raise the molten metal surface and thus re-fill the partial shrinkage cavity to compensate for the shrinkage. This filling operation may be done repeatedly in a series of discrete steps separated by pauses, each time first allowing a partial shrinkage cavity to form and then delivering molten metal to the molten metal pool 24 and then pausing again for further shrinkage. This step-wise repeated filling is explained further with reference to FIGS. 2A through 2H of the accompanying drawings. In these drawings, and also in FIG. 1, item 50 represents a surface height sensor used to monitor and control the molten metal filling operations. The sensor 50 is preferably positioned as close as possible to the spout 18 to sense the height of the molten metal pool immediately surrounding the spout. It is also to be noted that FIGS. 2A through 2H show only the upper parts of an ingot of much greater height.

Figure 2A:
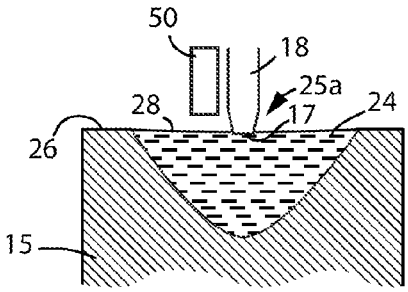
FIGS. 2A to 2H schematically show a cast ingot at progressive stages in the development and elimination of the shrinkage cavity.
Figure 2B:
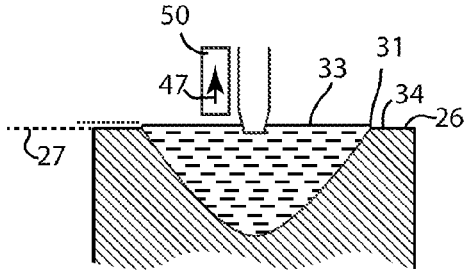

FIG. 2A shows the ingot and apparatus shortly after the completion of casting, i.e. shortly after the situation shown in FIG. 1. The distribution bag (if any) has been removed from the spout and the surface height detector 50 has been positioned close to the surface of the ingot. Based on information from the detector 50, the ingot 15 is allowed to stand after casting until region 28 of the upper surface 26 descends by a predetermined small amount (e.g. as little as 2 mm) to form a partial shrinkage cavity 25*a* (which is very shallow in this view). The surface region 28 is not allowed sufficient time to descend to the full extent required to create a completely formed shrinkage cavity 25 as shown in FIG. 1. In fact, the surface region is preferably not allowed to descend enough to expose the lower tip 17 of the spout, which would allow exposure of molten metal in the spout to air. Once the surface region 28 adjacent to the spout has descended by the predetermined amount, molten metal is fed from the spout 18 into the metal pool 24 to cause the partial shrinkage cavity 25*a* to re-fill (at least partially) and, in fact, preferably to over-fill as shown in FIG. 2B. That is to say, sufficient molten metal is introduced into the metal pool 24 to fill the partial cavity to a height above that of the surrounding solid parts 34 of the upper surface 26, i.e. to a position above the predetermined ingot surface height 27. Filling to a position above the height of the immediately surrounding solid parts 34 of the upper surface is possible because a downwardly turned meniscus 31 forms around the periphery of molten pool 24 and surface tension within the molten metal holds the pool within the horizontal confines of the partial cavity 25*a* even though its upper surface 33 is above the surface level 27 of the surrounding ingot as shown by the dotted line. Of course, the amount of molten metal supplied from the spout 18 should preferably not be so much that molten metal overflows the partial cavity 25*a* to spread across the surrounding surface of the ingot, although small and insignificant amounts of spillage from the partial cavity may be tolerated in practice. Generally, the height of the surface 33 may be up to about 8 mm above the surrounding solid parts 34 of the ingot, but an excess height in a range of 4-6 mm is more preferably provided.

Figure 2C:
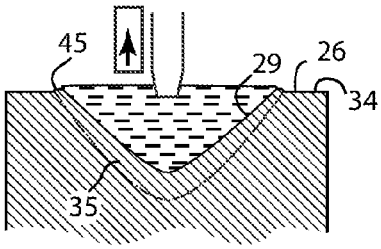
Figure 2D:
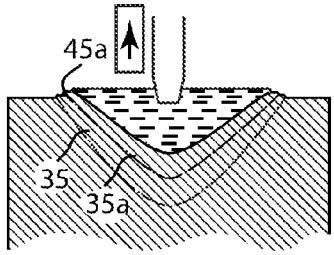

Once the partial cavity 25*a* has been over-filled to the desired extent as determined by detector 50, the flow of molten metal through the spout 18 is paused and the ingot is allowed to cool further. During this time, as shown in FIG. 2C, the solid/liquid interface 29 rises in the ingot due to cooling and solidification, forming a new solid layer 35, and the size of the metal pool 24 is reduced accordingly. The new layer 35 of solid metal extends up to the surface 26 around the shrinking metal pool 24 and forms a rim 45 all around the edge of the pool. The rim is raised relative to the surrounding solid areas 34 because of the over-filling of partial cavity 25*a* and because of the relatively rapid cooling of the metal in layer 35 which causes solidification of the metal before shrinkage has had a chance to draw down the surface height of the peripheral parts of the metal pool 24.

After the ingot has been allowed to cool for a period of time following the step of FIG. 2B, the upper surface 33 of the molten metal of the pool 24, except for that forming the rim 45 of FIG. 2C, is drawn down by metal shrinkage and contraction to form a further partial shrinkage cavity (not shown). When the further partial shrinkage cavity reaches a predetermined depth, as determined by detector 50, spout 18 is again opened and molten metal flows into the molten metal pool to again over-fill the partial shrinkage cavity to a level above that of the immediately surrounding ingot surface and rim 45, as shown in FIG. 2C. Once the further partial shrinkage cavity has been overfilled with molten metal, the flow of metal through the spout 18 is again paused and the ingot is allowed to cool further.

Figure 2E:
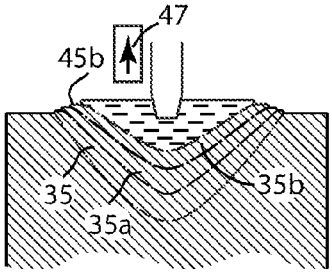
Figure 2F:
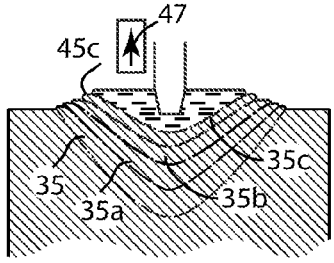
Figure 2G:
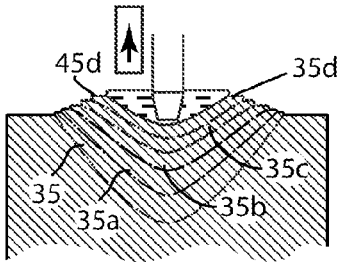
Figure 2H:
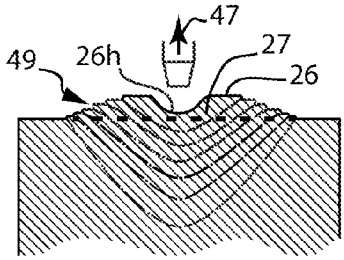

This process is repeated several times as shown in FIGS. 2D to 2G. That is to say, the ingot is allowed to stand for a further period of time until a still further partial shrinkage cavity is formed in the upper surface of the ingot during which time the interface 29 rises further to form new layers of metal 35*a*, 35*b*, 35*c* and 35*d*, each having raised rims 45*a*, 45*b*, 45*c* and 45*d*. Each further partial shrinkage cavity is itself over-filled with molten metal from the spout 18 up to a level above that of the surrounding rim formed by the previous over-filling operation. This repetitive or iterative procedure of allowing partial shrinkage cavities to form and then of over-filling the partial shrinkage cavities is continued until a point is reached at which any remaining shrinkage or contraction of the metal of the ingot will not cause any part of the surface 26 to descend below the predetermined height 27. The repetitive over-filling steps are then terminated and the spout 18 is removed from contact with the molten metal pool 24 by being raised (along with launder 20) as represented in FIG. 2H, which shows the condition when the ingot is fully solid throughout. It will be noticed that, even though there may be a partial cavity 25*h* remaining after full solidification, its lowermost point 26*h* is still above the predetermined height 27 representing the intended position of the end of the ingot.

Thus, after the over-filling operations are complete, the upper surface 26 of the ingot has a raised stepped crown 49 projecting above the predetermined height 27. When the ingot is rectangular, the crown 49 has the shape of a generally rectangular stepped pyramid, wherein the steps are formed by the rims created by the sequentially over-filling of the partial shrinkage cavities. In practice, the crown 49 may reach a total height of up to 150 mm over predetermined height 27, depending on the number of over-filling operations and the excess surface height achieved at each step, but has a more preferred height of up to about 50 mm. For example, seven such over-filling steps to an excess height of 4 mm each would produce a crown 49 having a total height of 28 mm, or perhaps a little less due to contraction of the metal upon cooling. For some purposes, a higher crown is more advantageous than a lower crown (e.g. because of less likelihood of causing "alligatoring" during subsequent ingot rolling). The crown 49 is generally not cut off because of its compatibility with subsequent rolling operations, but it may be cut off if desired, e.g. by sawing through the ingot at the level of predetermined height 27, to provide an ingot having a completely flat upper surface at the originally intended height. Even if the crown 49 is cut off, it does not contain a large quantity of metal, so the amount of metal that is scrapped or returned for recycling is not very great.

While the intention of this exemplary embodiment is to achieve over-filling of the partial shrinkage cavities at each partial filling step, an occasional mere filling (or perhaps even slight under-filling) can be employed in practice, especially if the reduced metal level thereby created is compensated for in one or more subsequent filling steps. However, in other exemplary embodiments, mere partial shrinkage cavity elimination may be the goal, in which case the filling steps are terminated before complete filling as represented by FIG. 2H. For example, the filling steps may be stopped at an intermediate stage, such as represented by FIG. 2E, following which the metal pool will solidify and shrink below the surface of the surrounding ingot, but the eventual shrinkage cavity will be smaller than the cavity that forms without such steps, e.g. by allowing the ingot as represented by FIG. 2A to cool fully.

The number of over-filling operations of the partial shrinkage cavities may vary, but it is normally at least 3 and usually no more than 15. A higher number of filling operations is better than a lower number because the molten metal surface is kept closer to the desired level 27 at all times. However, if too many filling operations are attempted, it is difficult to detect further partial cavity formation and to provide sufficiently small amounts of molten metal for the over-filling steps. Moreover, the raised rims 45 may not have time to solidify and form. Consequently, there is a trade-off among these considerations which leads to an optimum number of filling operations for each situation. This can be determined by trial and experimentation or by resort to computer models.

Figure 3:
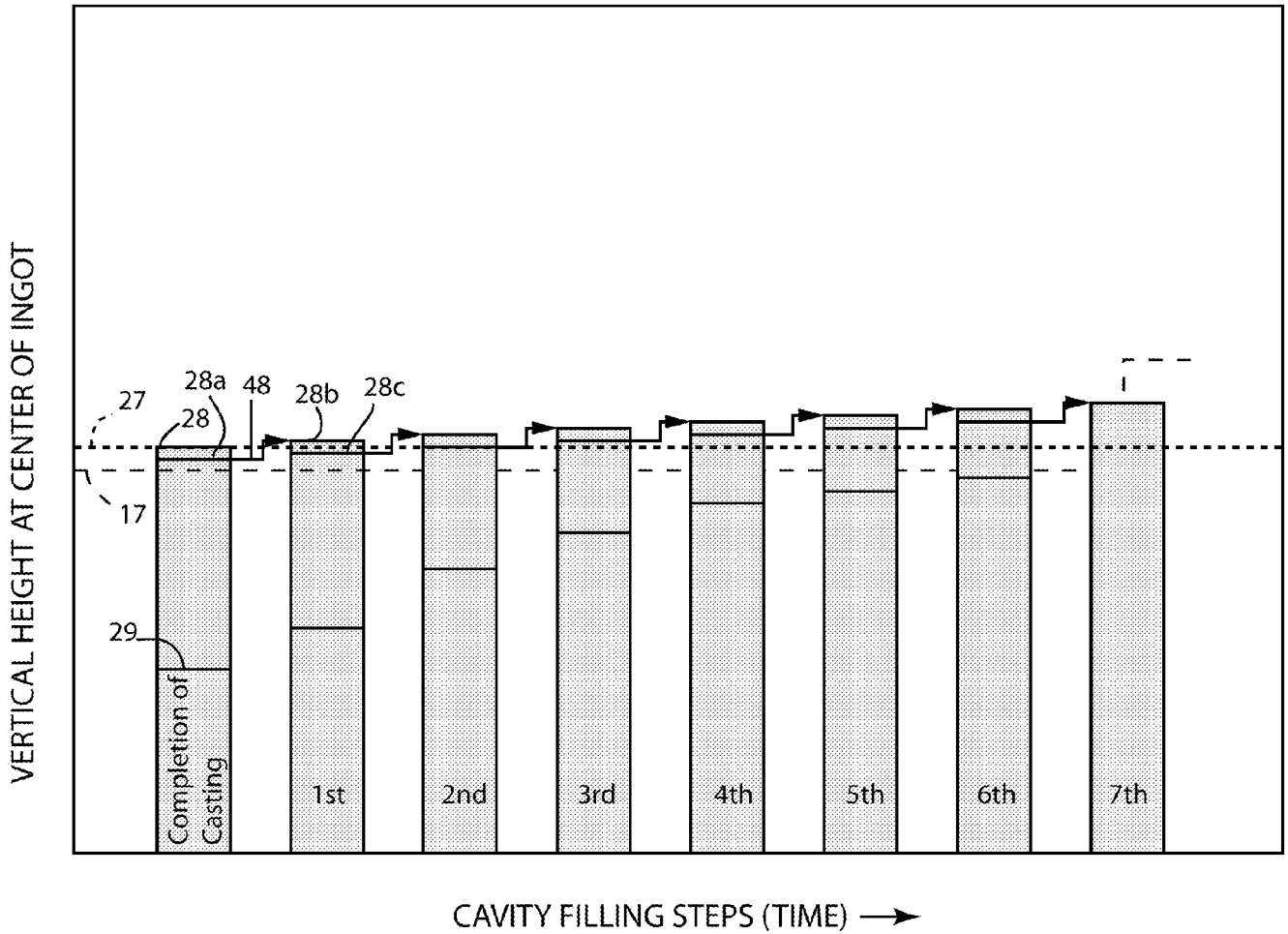
FIG. 3 is a graphical representation of the filling steps of FIGS. 2A to 2H.

The filling operations are also represented graphically in FIG. 3. The upstanding bars from left to right in the figure represent upper parts of the ingot immediately surrounding the spout at various stages in the procedure. The left hand bar represents the ingot at the completion of casting and shows the surface height 28 of the molten pool at the desired ingot height 27. The bar also shows the surface height 28*a* that, when detected, triggers the first cavity filling operation. The position of the interface 29 is indicated by a line identified by this numeral and the position of the tip 17 of the spout (which preferably does not change until the end of the procedure) is shown by broken line 17. As represented by stepped arrow 48, the first filling operation moves the surface from height 28*a* up to a new height 28*b* as shown in the second upstanding bar. Cooling then reduces the height to position 28*c*, which triggers a new filling operation, and so on.

Referring once again to FIG. 1, the metal level sensor 50 and the accompanying apparatus is described in more detail. The metal level sensor 50 is shown positioned close to one side of the spout 18 and, as previously noted, it is positioned and intended to sense the surface height of the molten metal immediately surrounding the spout 18 generally at the center of the ingot. This sensor incorporates an induction coil (not shown) that creates an induction current in the molten metal below it. The power in the induction coil is greater when the metal surface is closer and declines as the metal surface recedes. The measured power or current in the coil is thus translated to a measure of the distance of the molten metal surface 28 from the sensor. However, as indicated by the arrows 47 in FIGS. 2A to 2H, the sensor 50 is moved upwardly as the filling of the partial cavities proceeds in order to keep the sensor out of contact with the molten metal as its level rises. The vertical position of sensor 50 is varied up or down by electric or hydraulic motor 51 under instruction from a control circuit 52 (e.g. a programmable logic controller, PLC), these units being housed within a housing 53 that also holds a motor 54 that also takes instruction from the control circuit 52. Motor 54 operates a rod 55 that moves the control arm 23 around a pivot 56 to thereby raise or lower the control pin 21, when required.

During the cavity filling operations, the information from sensor 50 is fed to the controller 52 which determines when the control pin 21 is to be raised by motor 54 so that metal may flow into the metal pool 24 to fill a partial cavity, i.e. when the depth of the predetermined cavity reaches a predetermined limit. The sensor 50 senses the increase in height of the surface level of the molten metal added to the partial cavity, and based on this, the controller 52 determines when the control pin is to be lowered to shut off the metal flow through the spout 18. The controller may then cause motor 51 to raise the sensor 50, either continuously or in a step-wise manner, to maintain a suitable separation between the upper surface of the ingot and the sensor. The controller 52, based on information from sensor 50, accordingly determines how many over-filling operations are required and when they commence and terminate according to information pre-programmed into the controller.

Figure 4:
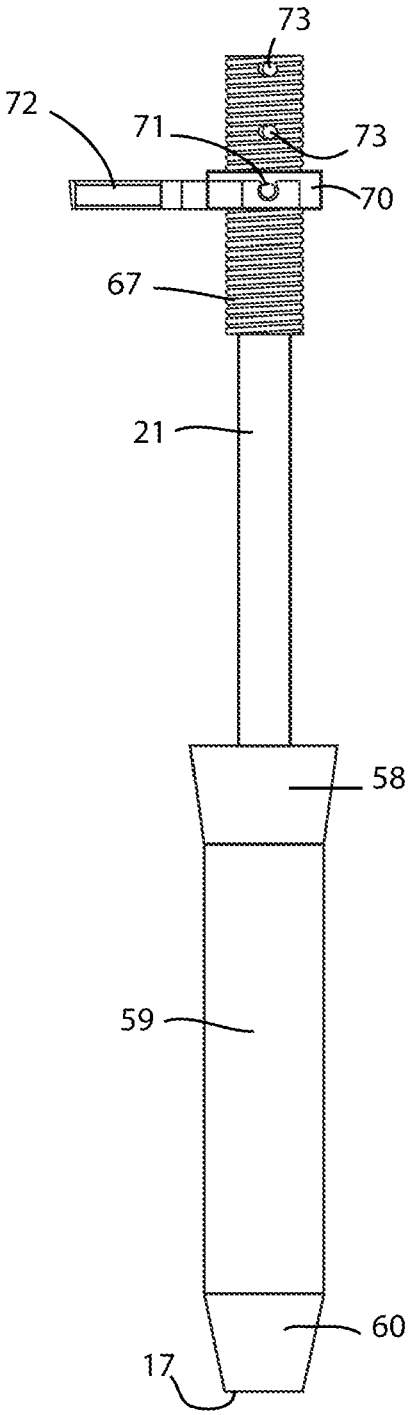
FIG. 4 is a side view of a spout for delivering molten metal to a casting mold and including a control pin.
Figure 5:
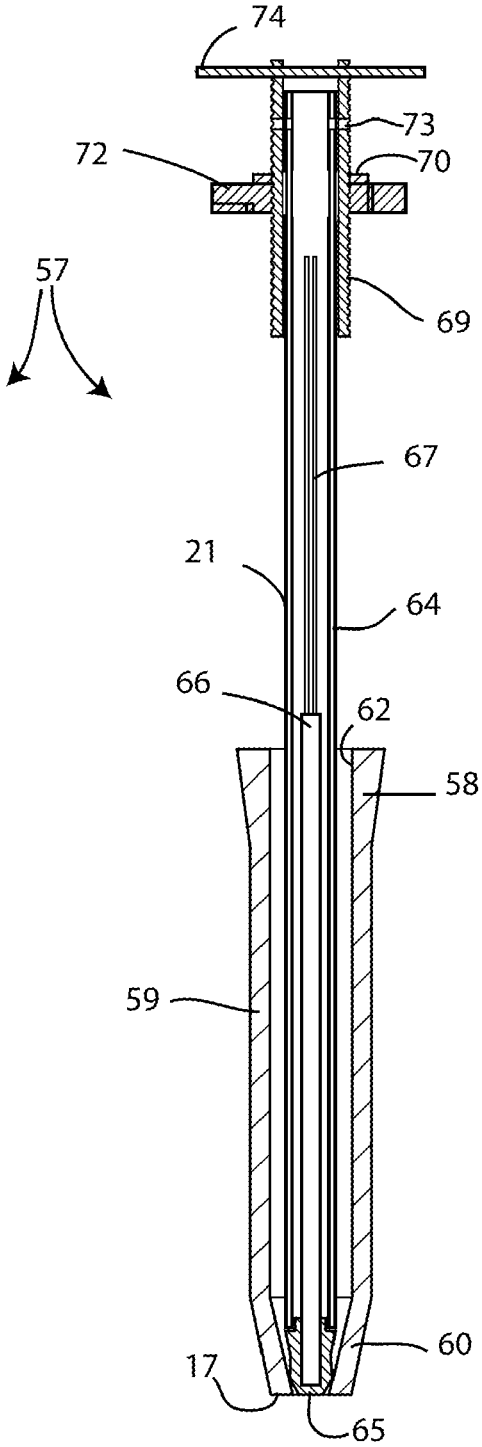
FIG. 5 is a vertical cross section of the spout and control pin of FIG. 4.

To enable molten metal to be added to the partial shrinkage cavities in the required way, it must be possible to supply just sufficient amounts of molten metal through the spout 18 at precisely the times required. This is achieved in this exemplary embodiment by means of the control pin 21 operating in the spout 18, as previously indicated. A suitable control pin and spout combination 57 is shown in FIGS. 4 and 5 of the accompanying drawings. In this exemplary embodiment, the spout 18 is a tubular body preferably made of a refractory ceramic material that is resistant to attack by molten metal of the kind used for the casting operation. The outer surface of the tubular body has an enlarged outwardly tapering upper end 58, a central cylindrical barrel 59, and an inwardly tapering nozzle 60 leading to tip 17. The upper end 58 is shaped to fit within a correspondingly shaped hole in a lower wall 61 of a launder 20 (see FIG. 1), the fit being sufficiently precise to prevent metal leakage while retaining the spout firmly, but removably, in place. An inner surface 62 of the spout (FIG. 5) is cylindrical for most of the distance from the upper end 58 to the nozzle 60, but it tapers inwardly to the same extent as the nozzle at the lower end. The tapered section of the inner surface 60 works in co-operation with control pin 21 to restrict and block the nozzle when desired. The control pin 21 is in the form of a hollow tube 64 carrying a contoured plug 65 of ceramic material at its lower end. When the control pin is in the lowered position as shown in FIG. 5, flow of molten metal through the spout is completely blocked. When the control pin is raised, molten metal may flow around the plug 65, and the area of the opening between the plug and spout increases as the plug is raised until it reaches the cylindrical part of the inner surface of the spout. Hence, the rate of flow of the molten metal may be controlled quite precisely by appropriately raising or lowering the control pin 21. The fact that the plug 65 is provided immediately adjacent to the tip 17 means that metal flow is shut off instantly once the control pin is fully lowered as there is no metal beneath the plug to continue to drain from the tip 17.

In order to keep any metal in the spout 18 molten at all times, the control pin 21 is provided in its interior with an electrical heater 66 supplied with electrical leads 67 that are connected via wires (not shown) to an external electrical supply (not shown). The electrical heater 66 is attached to the plug 65 at its lower end, and may be made of a ceramic material molded around heating wires so that, if the hollow control pin 21 should leak, the electrical heating wires of the heater 66 will be protected from attack by molten metal.

At its upper end, the control pin 21 has an externally-threaded element 69 that carries an internally threaded ring 70 provided with diametrically opposed projecting pins 71 which are pivotally retained in corresponding grooves on a Y-shaped end section 72 of control arm 23. As previously described in connection with FIG. 1, the control arm 23 raises or lowers the pin, and the pivotal arrangement provided by the pins 71 allows the control pin 21 to remain vertical and axially aligned with the spout 18 no matter what the angle of the control arm 23 may be as it is pivoted around pivot 56. The threaded connection between the ring 70 and the threaded element 69 allows the control rod 21 to be raised or lowered independently of the control arm 23 so that the control pin may be properly seated in the spout 18 to fully close the spout when the control pin is in the lowermost position allowed by control arm 23. The threaded element 69 is provided with through-holes 73 at various heights so that a twist-pin 75 may be temporarily inserted to facilitate rotation of the control pin 21.

The electrical heater 66 is capable of delivering sufficient heat to the metal within the spout 18 to keep the metal molten even when the flow through the spout is completely shut off by the control pin 21. In an alternative embodiment, the body of the spout 18 may contain an embedded heater or may have an external heater to keep the metal inside the spout molten at all times. As a still further alternative, a control pin and spout combination as disclosed in US 2010/0032455 may be employed (the disclosure of US 2010/0032455 is specifically incorporated herein by this reference).

For the exemplary embodiments to work in the intended manner, it is also necessary to ensure that there is sufficient metal 19 in the launder 20 to overfill as many partial shrinkage cavities as may be needed, and that the available metal is kept molten for delivery to and through the spout 18. One way in which this can be achieved is best explained in connection with FIG. 6, which is a simplified plan view of a DC casting table capable of casting two side-by-side ingots simultaneously. In this apparatus, tandem casting molds 75 are traversed from above by open-topped launder 20 provided with two spout and pin combinations 57 of the kind shown in FIGS. 4 and 5, one for each casting mold. In this drawing, control arms 23 for the control pins 21 are also clearly visible. One end 20*a* of the launder is permanently blocked and the other end 20*b* is connected to a metal melting furnace (not shown) via additional launders, channels, pipes, etc. (not shown). After completion of the main casting operation, a dam 77 is inserted into launder 20 and is held by grooves (not shown) in the sidewalls and bottom of the launder to block any metal flow. Further supply of molten metal from the furnace is then terminated, but a pool of molten metal 19 is retained by the dam in the part of the launder above the casting molds 75. The launder has a lining 78 of refractory material that provides thermal insulation so that the metal trapped in the launder by the dam cools slowly and remains molten for a considerable period of time. If necessary, however, the dammed part of the launder may be heated in order to keep the metal pool molten for delivery to the spouts 18. For this reason, the walls of the launder may include an embedded electrical heater (not shown), the launder may include an immersion heater submerged below the molten metal, or heating may be provided to the outside of the launder or directly to the metal from above.

Figure 6:
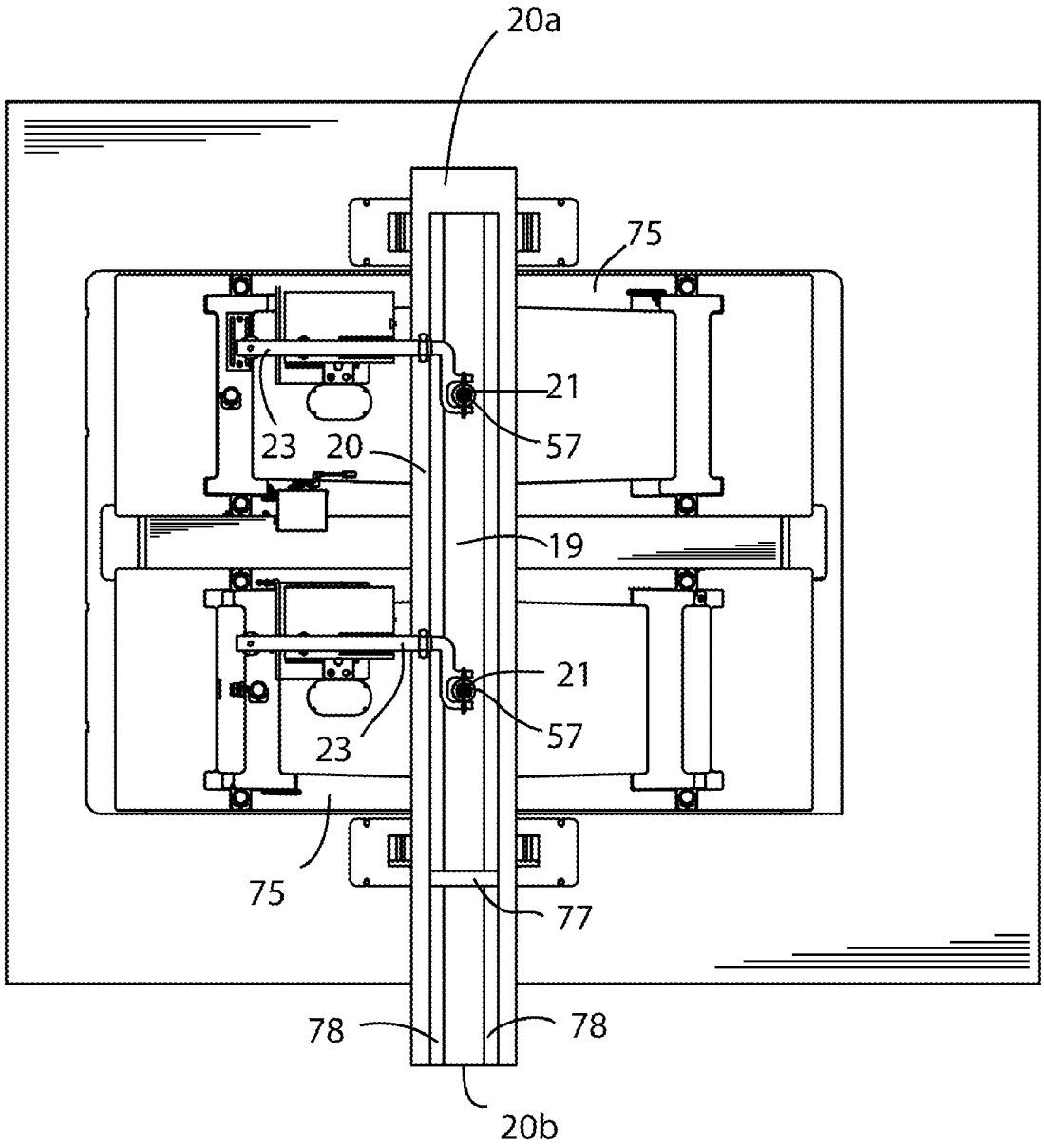
FIG. 6 is a top plan view of a casting table for casting two ingots simultaneously and operated according to exemplary embodiments herein.

Using the apparatus of FIG. 6, two tandem metal ingots may be cast side by side, and shrinkage cavities in the ingots eliminated or avoided by the procedures outlined above.

While it is desirable in some embodiments to provide a spout 18 with an internal electrical heater of the kind indicated above, this is not always necessary. The heat needed to keep the metal from freezing in the spout 18 may come from the sensible or latent heat of the metal in the trough 20 or in the spout 18 surrounding the pin 21, or from the heat retained in or introduced into the solid walls of the trough or spout. At the start of the casting operation, for example, the spout 18 and pin 21 may be preheated by some form of external heating device, e.g. a propane torch or other device having an open flame. At the end of the casting operation, the metal contact surfaces of the spout and pin are inevitably quite hot as they have been exposed to the superheated molten metal during casting. The spout and pin remain hot enough for a time sufficient to allow the topping up procedure to take place. For example, a total of 8 or more topping up iterations may be carried out without metal freezing. If the trough 20 is equipped with electrical wall or immersion heaters (for the molten metal), the number of topping up iterations may have not specific limit and, in practice, may amount to 15 or more.

For a more complete understanding of the exemplary embodiments, a description of a casting operation is provided in the following.

Example 1

Aluminum alloy ingots were cast in a tandem mold direct chill casting apparatus of the kind shown in plan view in FIG. 6 of the accompanying drawings.

Prior to the cast, heated control pins were inserted into the spouts and powered at 1000 watts each (full power). At 100 mm into the cast, the power was reduced to 25% (250 watts). At a cast length of 200 mm before the end of the cast (stoppage of bottom block), the power to the control pin heaters was increased from 250 watts to 1000 watts to ensure that the metal in the spouts stayed molten before the end of cast filling process.

The end-of-cast sequence was initiated manually when the desired length of the cast was reached. This caused the furnace to tilt back and the control pins to close the spouts. The bottom block continued to move down. As the furnace began to tilt back, a dam was placed manually into the distribution launder to prevent metal flowing back to the furnace, thus maintaining a sufficient volume of molten metal for filling of the shrinkage cavities.

When the metal level in either mold dropped by 10 mm below a setpoint, the descent of the bottom block was stopped, the mold metal level in each mold was saved as a setpoint in a PLC memory, the metal level sensors were retracted and the distribution launder was raised straight up. When the launder was fully raised, the distribution bags (used to direct and filter the molten metal) were removed and an operator lowered the distribution launder and extended the mold level sensors by operating a control.

After a 15 second delay to ensure that the launder and metal level sensors were fully lowered, the mold metal levels saved as indicated above became the starting setpoints and the sensor began to ramp up at a rate of about 2.0 mm/min.

The molten metal levels in the mold dropped slowly as the metal solidified. The PLC compared the actual metal level in each mold to its ramped setpoint. When the actual metal level in a mold dropped by 2.0 mm below the setpoint, the respective control pin was opened to a 25% flow rate. The metal level rose in a few seconds until the actual metal level reached the new setpoint, at which time the control pin was closed. This was repeated until stopped by the operator after about 14 minutes. At this time, the molten metal area in the center of the ingot had decreased (due to metal freezing) to a point where measurement by the mold metal level sensors was no longer possible (an oval shaped metal pool reached a dimension of about 200 mm×450 mm.

The filling process was then stopped, at which time the launder dam was removed and the mold metal sensors were raised. After eight seconds, the distribution launder was tilted and the control pins were opened to drain any remaining metal trapped in the spouts.

Figure 7B:
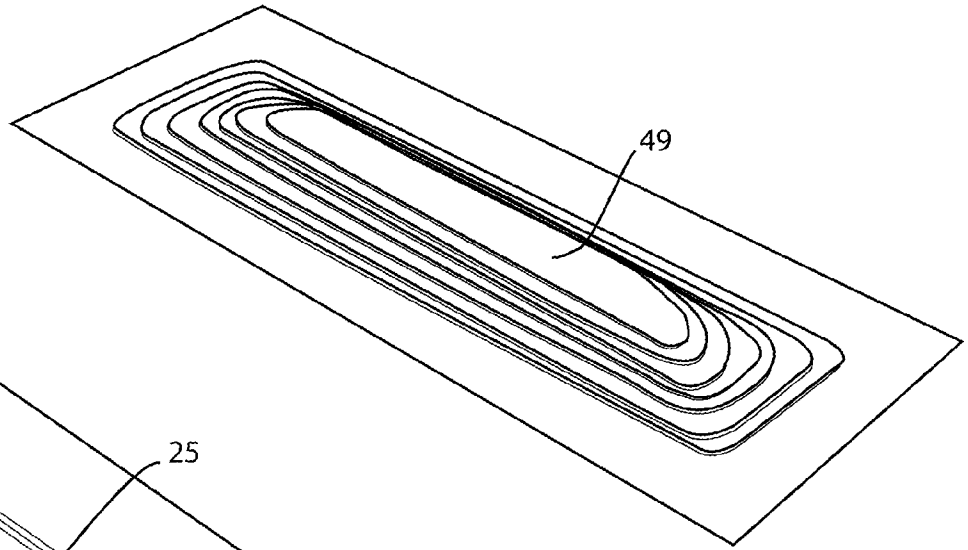
FIGS. 7A and 7B are drawings based on photographs of the tops of ingots produced without any attempt to compensate for metal shrinkage (FIG. 7A), and produced with compensation for metal shrinkage according to an exemplary embodiment (FIG. 7B)
Figure 7A:
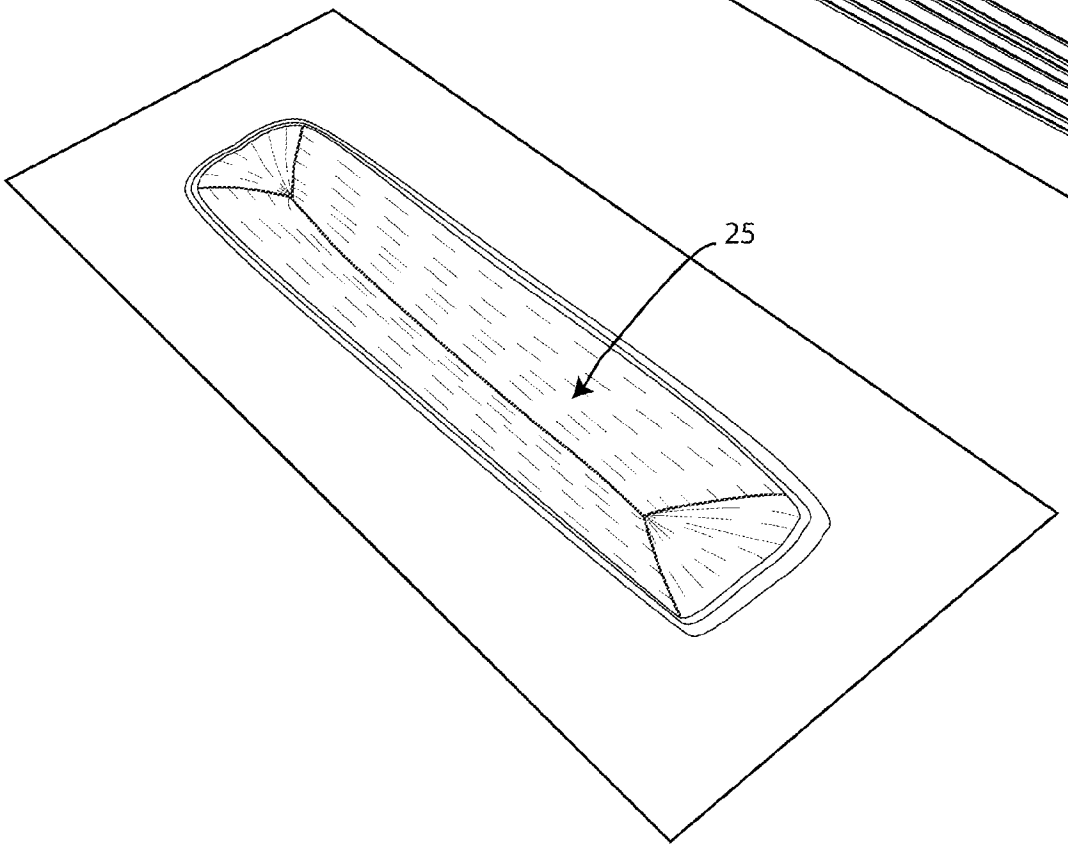

FIGS. 7A and 7B of the accompanying drawings are drawings based on photographs showing the tops of two ingots. The ingot of FIG. 7A was cast without any attempt to eliminate a shrinkage cavity (prior art) and such a cavity 25 is visible in the drawing. The ingot of FIG. 7B was formed with the cavity filling procedure as indicated above and it can be seen that the shrinkage cavity of FIG. 7A has been completely eliminated and replaced by an upstanding striated or stepped crown 49. The original photograph showed some metal overflow over the stepwise projection resulting from an unintended continuation of metal flow from the spout after the intended end of the cavity elimination procedure. However, this overflow has been omitted from FIG. 7B for the sake of clarity.

Example 2

A casting operation of the kind described in Example 1 was carried out, again in the apparatus of the general kind shown in FIG. 6, but with unheated control pins As casting proceeded, the heat of the molten metal kept the spouts and pins sufficiently hot to avoid freezing and blockage. The temperature of the molten metal supplied to the casting apparatus was sufficiently elevated to avoid freezing caused by heat losses in the apparatus. The details of the casting procedure are as follows.

Casting was carried out in a mold table holding five casting molds, but the center mold (position number 3) was not used so only four ingots were cast simultaneously. In fact, the ingots cast in this way were stub ingots, i.e. ingots of less than normal height. Automation changes were added to the PLC program to modify the timing of the trough tilt and metal level control pins. At end-of-cast, the furnace was tilted back as normal. When the metal level in the trough dropped to a certain level due to contraction, the operator initiated another end-of-cast signal, which caused the platen to stop, the metal dam in the main trough to close, and the metal level control pins to close. The launder remained down, allowing all the metal in the trough at that time to remain therein. The automatic level control equipment captured a reading for the metal level in the head of each ingot and established this new level as the current head level setpoint. A ramp was set in the automation to raise the head level setpoint over a length of time. As the metal in the ingot head shrank, the metal level control (MLC) read the difference between the rising setpoint and the actual level. The pins were opened to release metal into the ingot heads when the differences reached a certain threshold. When the ingot heads were sufficiently solidified, the operator initiated a final end-of-cast signal which lifted the launder on the casting station and dumped the remaining metal as in a normal end of cast routine.

The practical details of the cast were as follows:

Mold Size—30.2×62.2 inches (76.7×158 cm)

Starting heads—Aluminum, 13 inches (33 cm) tall

Alloy—AA3104

Skim rings were used

Cast length—70 inches (178 cm), End Cast initiated at 60 inches (152 cm)

Trough temp at start of cast—680° C.

Trough temp at furnace tilt back—678° C.

Standard un-heated control pins.

The cast proceeded as follows:

Stub cast initiated normally

Operator pushed End-of-Cast button to tilt furnace back

Operator pushed End-of-Cast button again when laser showed 6 inch metal level just before main dam Pins closed Platen stopped Main dam closed Hand dam placed between main dam and Alcan bed filter (ABF) outlet Operators clean trough between furnace and ABF inlet as normal Automation ramped up metal level in ingot heads to ramp at 0.15 inch/minute (4 mm/minute)

Operator pushed End-of-Cast button final time to initiate trough break and drain metal.

Pins remained closed for a short period of time and were then opened

Decision to end test was based on observation that the skim ring in #1 was beginning to freeze into the ingot head.

Time from closing #3 Dam to trough break at end of test was 7 minutes.

Tee-trough pulled and skull removed from the trough

The skull left in the trough was very thick and heavy

Metal froze into the spouts at positions 1 and 5

The head bags were very heavy and full of mush when they were removed.

The ingot head contours clearly showed the automatic equipment allowing more metal into the ingot head in the form of steps. In total, eight partial cavity filling steps were carried out. All ingot heads measured a crown of 1-1.5 inches (2.5 to 3.8 cm) above the standard ingot head.

Mold 5 showed a "stepped" ingot head, indicating that the pin sealed correctly.

Molds 1, 2, and 4 had a sloped ingot heads, indicated that the pins were not sealed properly and allowed metal to leak past continuously.

Figure 8:
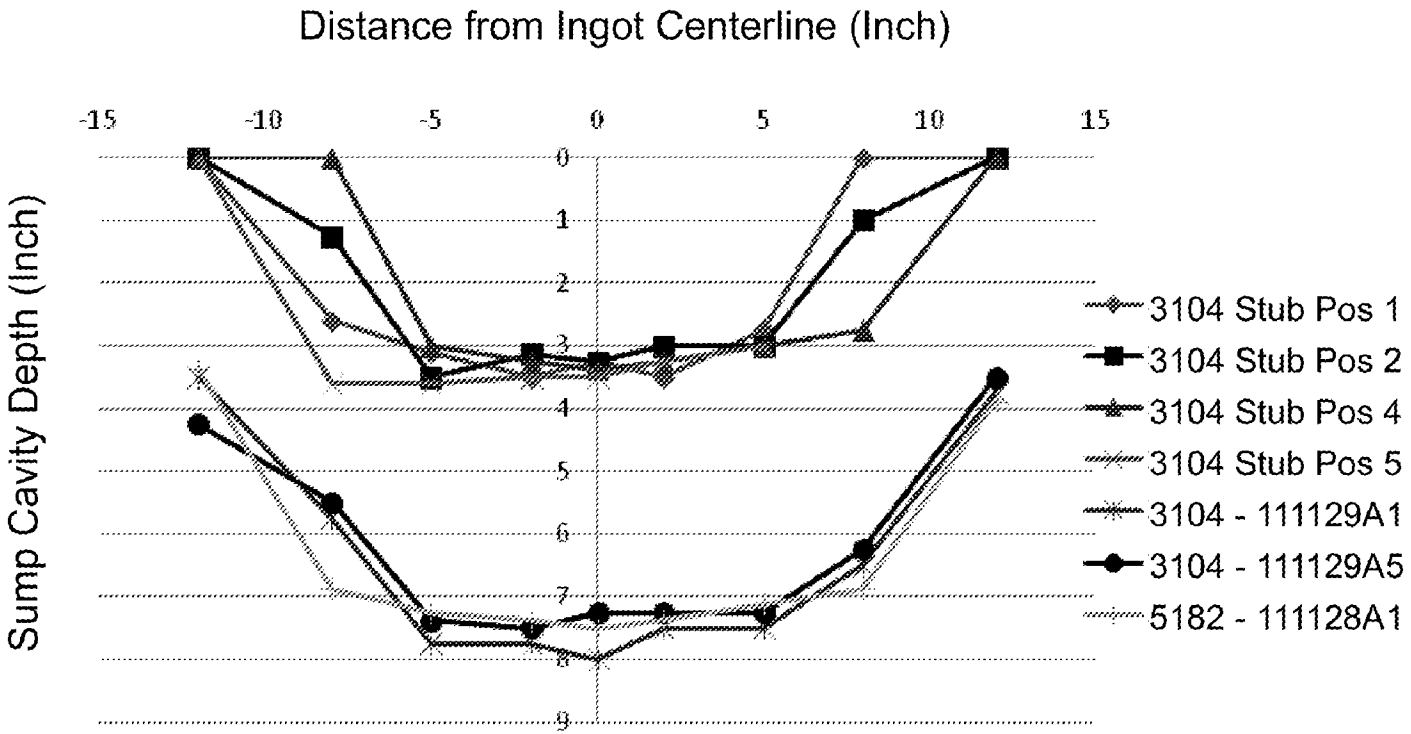
FIG. 8 is a graph showing ingot head cavity comparisons for ingots cast as described in Example 2 of the description below.

Shrinkage cavity measurements were taken with an ultrasound unit at the ingot centerline and at ±2, 5, 8, and 12 inches (±5.1, 12.7, 20.3 and 30.5 cm) from the centerline. The results are shown in FIG. 8 of the accompanying drawings.

The test ingot cavities measured from 3 inches (7.6 cm) to 3.5 (8.9 cm) inches at the deepest measurements, taken at centerline and ±2 inches (±5 cm).

For comparison, three full length ingots were cast in the same molds directly after the stub casts, but without partial filling steps. Two ingots were of the same alloy as the stub casts (AA3104-111129A1 and AA3104-111129A5)) and one was of a different alloy (AA5182-111128A1). Control measurements taken on the two ingots from the following comparison cast (111129-A1 and A5) showed cavity depths from 7.25 inches (18.5 cm) to 8.0 inches (20.3 cm), also taken at centerline and at ±2 inches (±5 cm) from the centerline. Control measurements taken on the 5182 ingot 111128-A1 showed cavity depths from 7.375 inches (18.7 cm) to 7.5 inches (19.1 cm), also taken at centerline and at ±2 inches (±5 cm).

At the end of the test, there was almost no metal left in the Tee trough, and that metal was turning to mush.

This was the first cast after 9.5 hours without casting, and it was a short cast.

The metal temperature in the trough at the end of cast was about 10° C. lower than typical on a cast of alloy AA3104.

In conclusion, this test showed that:

Head cavity reduction using automation controlled end-of-cast sequence is a viable method of reducing the size of the ingot head shrinkage cavity.

On this 30.2 inch×62.2 inch (76.7×158 cm) CBS ingot, the useable ingot length increased by 3.75 inches (9.5 cm) if the shortest standard cavity and longest reduced cavity are compared. At 183 lb/inch (32.75 kg/cm), this equates to approximately 700 lbs (318 kg) more useable metal per ingot. Considering a 54,490 lb (24,768 kg) ingot, that is a potential for up to 1.2% capacity increase.

Example 3

The procedure of Example 2 is repeated except that an electrical immersion heater is positioned within the trough 20 to provide super-heat for the molten metal before it enters the troughs 18. The heater is operated before casting commences to ensure that freezing of metal does not take place in the spouts 18 as the metal first runs through them. Additionally, the spouts 18 and pins 21 are pre-heated by means of torches, as in Example 2.

The immersion heater is operated during casting to avoid freezing of metal and is kept in operation when casting is terminated so that, during the topping-up procedure, the molten metal entering the spouts 18 does not freeze. By this means, 12 to 15 topping up iterations are achieved before the spout 18 and pin 21 cool sufficiently to risk blockage.

What is claimed is:

1. A method of fully or partially eliminating a shrinkage cavity in a metal ingot cast by direct chill casting, the method comprising:

casting a metal ingot by introducing molten metal into a direct chill casting mold from a spout to form an upright ingot having an upper surface at a predetermined height;

upon completion of said casting, terminating molten metal flow through the spout while maintaining sufficient heat in metal within and supplying the spout to keep the metal molten for subsequent delivery through the spout;

allowing a partial shrinkage cavity to form in said upper surface as metal of the ingot contracts, then at least partially filling said partial shrinkage cavity while avoiding all or significant spillage of molten metal from the partial cavity, and then terminating flow of metal through said spout;

repeating at least once said steps of allowing a partial shrinkage cavity to form in said upper surface, then at least partially filling said partial shrinkage cavity with molten metal from said spout, and then terminating the flow of metal through the spout;

terminating said repetition of said steps; and removing said spout from contact with molten metal of said ingot and allowing all parts of said ingot to cool to a temperature at which the metal is fully solid.

2. The method of claim 1, wherein said terminating of said repetition of said steps is carried out only when no further shrinkage or contraction of said metal of the ingot causes any part of said upper surface to shrink or contract below said predetermined height of the ingot.

3. The method of claim 1, wherein at least some of said at least partial fillings of said partial shrinkage cavities comprises over-filling said cavities.

4. The method of claim 1, wherein all of said at least partial fillings of said partial shrinkage cavities comprises over-filling said cavities.

5. The method of claim 1, wherein the height of said upper surface is determined and each at least partial filling is commenced when said height falls to a predetermined lower level and is terminated when said height is raised to a predetermined upper level consistent with said at least partial filling.

6. The method of claim 5, wherein said predetermined lower level and said predetermined upper level are each set to a higher value after each at least partial filling prior to said termination of said repetition.

7. The method of claim 5, wherein said height of said upper surface is determined by a surface level sensor and said sensor is raised after each over-filling by an amount at least corresponding to said higher value of said upper level.

8. The method of claim 5, wherein said height of said upper surface is determined by a surface level sensor and said sensor is gradually and continuously raised from said completion of casting to said termination of repetition of said steps.

9. The method of claim 1, wherein said spout is maintained at a fixed height from said completion of casting until said removing of the spout.

10. The method of claim 1, wherein said steps are repeated 2 to 15 times.

11. The method of claim 3, wherein said partial shrinkage cavities are over-filled by an excess height of 4-6 mm.

12. The method of claim 1, wherein said steps are repeated until said ingot has a raised crown of up to 150 mm in total height after allowing all parts of said ingot to cool to a temperature at which the metal is fully solid.

13. The method of claim 1, wherein said steps are repeated until said ingot has a raised crown of up to 50 mm in total height after allowing all parts of said ingot to cool to a temperature at which the metal is fully solid.

14. The method of claim 1, wherein sufficient heat is maintained in metal within the spout to keep said metal molten by introducing heat within or surrounding the spout.

15. The method of claim 1, wherein sufficient heat is maintained in metal supplying the spout to keep said metal molten by introducing heat within a launder supplying the spout with molten metal.

16. The method of claim 1, wherein a distribution bag is connected to said spout during said casting, and wherein said distribution bag is removed from said spout upon said completion of casting.

17. The method of claim 1, wherein a lower tip of said spout is maintained below a surface of molten metal in said ingot at all times during said steps of allowing partial shrinkage cavities to form in said upper surface and then at least partially filling said partial shrinkage cavities.

18. The method of claim 17, wherein said at least partially filling of a partial shrinkage cavity is commenced before shrinkage of said partial shrinkage cavity exposes said lower tip of the spout.

19. The method of claim 1, wherein said spout is positioned at or near a center of said upper surface of the ingot.

20. The method of claim 1, wherein there is a pause between each of said steps of at least partially filling said partial shrinkage cavity.

21. The method of claim 20, wherein said pause is of at least 5 seconds in duration.

22. A method of eliminating a shrinkage cavity in a metal ingot cast by direct chill casting, the method comprising:

casting a metal ingot by introducing molten metal into a direct chill casting mold from a spout to form an upright ingot having an upper surface at a predetermined height;

upon completion of said casting, terminating molten metal flow through the spout while maintaining sufficient heat in metal within and supplying the spout to keep the metal molten for subsequent delivery through the spout;

allowing a partial shrinkage cavity to form in said upper surface as metal of the ingot contracts, then over-filling said partial shrinkage cavity while avoiding all or significant spillage of molten metal from the partial cavity, and then terminating flow of metal through said spout;

repeating said steps of allowing a partial shrinkage cavity to form in said upper surface, then over-filling said partial shrinkage cavity with molten metal from said spout, and then terminating the flow of metal through the spout;

terminating said repetition of said steps when no further shrinkage or contraction of said metal of the ingot causes any part of said upper surface to shrink or contract below said predetermined height; and removing said spout from contact with molten metal of said ingot and allowing all parts of said ingot to cool to a temperature at which the metal is fully solid.

* * * * *